United States Patent [19]

Wicklund

[11] 4,100,691

[45] Jul. 18, 1978

[54] SAFETY CARTRIDGE INDICATOR FOR GUNS

[76] Inventor: Michael M. Wicklund, 2902 S. Delaware, Englewood, Colo. 80110

[21] Appl. No.: 747,629

[22] Filed: Dec. 6, 1976

[51] Int. Cl.[2] ..... F41C 27/12

[52] U.S. Cl. ..... 42/1 D

[58] Field of Search ..... 42/1 D

[56] References Cited

U.S. PATENT DOCUMENTS

| | | | |
|---|---|---|---|
| 439,551 | 10/1890 | Pheatt | 42/1 D |
| 891,438 | 6/1908 | Peard | 42/1 D |
| 1,219,896 | 3/1917 | Yanert | 42/1 D |
| 1,459,284 | 6/1923 | Declaye | 42/1 D |
| 2,145,328 | 1/1939 | Walther | 42/1 D |

*Primary Examiner*—Charles T. Jordan

*Attorney, Agent, or Firm*—Richard D. Law

[57] ABSTRACT

A slidable pin, in a gun breech bolt, impinges on a chambered cartridge sliding rearwardly, striking the arm of a pivoted angle indicator raising an indicator surface above the bolt in view of the user. A spring detent normally holds the pin forwardly so as to not strike the indicator when no cartridge is in the chamber.

2 Claims, 7 Drawing Figures

SAFETY CARTRIDGE INDICATOR FOR GUNS

The present invention relates to safety devices for firearms, and more particularly to safety devices which indicate the presence of a cartridge in the chamber of a firearm. As such, the present invention is called a "Safety Cartridge Indicator for Guns".

PRIOR ART

Safety cartridge-indicators for guns, to indicate the presence of a cartridge in the chamber, have heretofore been proposed. One type of an indicator extends from a side opening in the chamber of a gun barrel to be projected whenever a cartridge is in the chamber, Luciani U.S. Pat. No. 2,850,827. Another type proposed is associated with the cartridge extractor on the breech bolt, Kelley U.S. Pat. No. 3,401,665. Yet another type involves a small opening at the breech which will permit the cartridge to be viewed. In U.S. Pat. No. 3,747,251, Baker shows an indicator for indicating the cocked and ready for firing condition of a firearm. Also, U.S. Pat. Nos. 1,992,934 and 2,100,273 show indicators for in chamber cartridges of the pivoted type. None of thes expedients have been found to be satisfactory. An opening in the side of the chamber of a gun barrel is not desirable because of the intense pressures encountered when a cartridge is fired. An indicator associated with the extractor is not always at a suitable location to be easily viewed, and the extractor movement is relatively small requiring an excessive magnification of its movement for easy observation.

Although such safety devices have been propesed, they are not in use because of their apparent shortcomings. In addition, it is generally conceded that the normal conventional safety on a gun is sufficient to prevent an accident. However, the ordinary safety does not allow for the type of accident where an individual is playing with the gun assuming that it is not loaded. A safety which prevents accidental release of the firing pin cannot protect an individual from an "I didn't know it was loaded" type of accident.

GENERAL STATEMENT OF THE INVENTION

The present invention was conceived and developed with the foregoing and other considerations in view. This invention comprises, in essence, a cartridge indicator safety device having a slide pin extending from the rim socket of the breech bolt which is pushed into the bolt to lift a warning tab at an exposed and visible surface on the bolt. The warning tab and the slide pin are resiliently biased to a normal retracted position whenever no cartridge is in the chamber of the gun. The slide pin may be located in the rim socket at any position to permit the tab to be exposed at a suitable location at the surface of the breech bolt where it may be easily seen but out of the way from other components associated with the breech bolt.

OBJECTS AND ADVANTAGES OF THE INVENTION

It follows that an object of the invention is to provide a novel and improved safety cartridge indicator for a gun which will indicate the presence of a cartridge in the chamber of the gun to minimize and even eliminate the "I didn't know the gun was loaded" type of accident.

Another object of the invention is to provide a novel and improved safety cartridge indicator for a gun which may be incorporated into the components at the breech of the gun in an arrangement which will not interfere with the structure of the bolt retaining components of the gun nor with the sighting of the gun when it is being used.

Another object of the invention is to provide a novel and improved safety cartridge indicator for guns which may be positioned at an easily seen and easily felt location near the breech of the gun.

Another object of the invention is to provide a novel and improved safety cartridge indicator for guns which can be used with a number of different types of guns.

Other objects of the invention are to provide a novel and improved safety cartridge indicator for guns which is a simple, neat appearing, economical, reliable, and durable unit.

DESCRIPTION OF DRAWINGS

With the foregoing and other objects in view, my present invention comprises certain constructions, combinations and arrangements of parts and elements as hereinafter described, defined in the appended claims, and illustrated in preferred embodiment by the accompanying drawing in which:

SPECIFIC DESCRIPTION OF THE INVENTION

Figure 1:
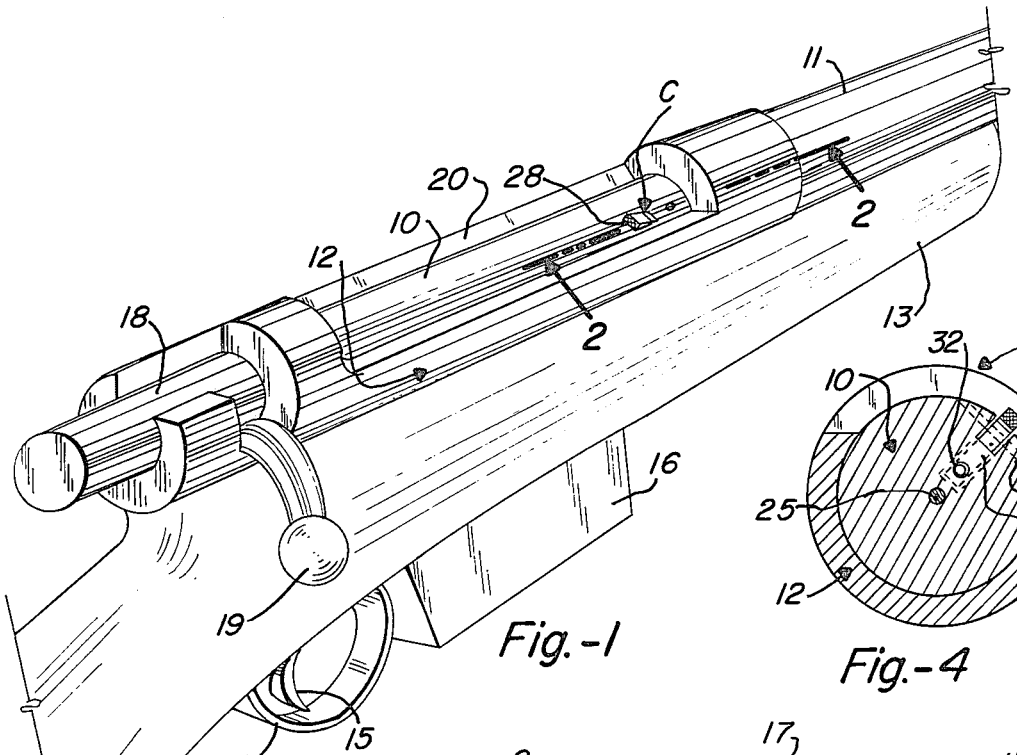
FIG. 1 is a fragmentary perspective view of the breech section of a bolt action type rifle wherein the improved safety cartridge indicator is located, with the indicator being raised above the surface of the bolt to indicate the presence of a cartridge therein.
Figure 4:
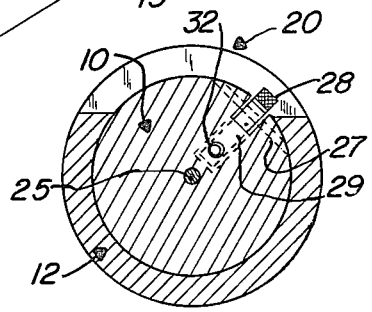
FIG. 4 is a transverse sectional view as taken from the indicated line 4—4 at FIG. 2.

Referring more particularly to the drawing, FIG. 1 illustrates the breech section of a typical bolt action rifle having an improved cartridge indicator C mounted in the cylindrical bolt 10 in accordance with the invention. The rifle will include a barrel 11 and a receiver 12 affixed to the barrel. The bolt 10 is slidably and rotatably carried in the receiver 12, and a stock 13 carries the barrel and receiver in a conventional manner. A trigger guard 14, trigger 15 and a cartridge clip 16 are located at the underside of the stock. In further detail, the receiver is a tubular structure extended rearwardly from the barrel and is affixed to the breech of the barrel as by threads 17 as in the manner illustrated at FIGS. 2 and 3. The receiver 12 will include a bayonet slot 18 at its rearward end to receive the bolt lever 19 of the bolt 10 and a cartridge ejection slot 20 at the breech end of the barrel.

The breech end of the barrel is formed to provide a cartridge chamber 21. The forward end of the bolt 10 will abut against the breech end of the barrel and this forward end of the bolt is formed as a socket 22 to receive the rim portion 23 of a cartridge 24. An axially centered firing pin 25 is carried within this bolt to strike and fire the cap of the cartridge 24. A hook, not shown, is provided at the rim socket 22 to grip the rim 23 of a cartridge to facilitate extracting it from the chamber 21, as is conventional.

The improved cartridge indicator C is carried in the bolt 10 immediately behind the rim socket. The location of the indicator is at the cartridge ejection slot 20 of the receiver, at the top side of the unit where it can be easily seen. It may, however, be placed at other locations. This indicator C will be adjacent to the right hand side of the slot 20 when the bolt lever 19 is rotated to a locked position as indicated at FIG. 1. It will rotate to the opposite side of the slot whenever the bolt lever is lifted for shifting the bolt. This indicator C is a rectangular, block-shaped member which lies flately in a socket 26 in the bolt with its upper face being normally at the surface of the bolt and in an out-of-the-way position and where it will not be noticeable nor interfere with the normal action of the bolt. The indicator C is carried upon a transverse pivot pin 27 at its forward end, with the pin being anchored in the bolt 10 so that the rear end of the indicator block C may be raised out of its socket to expose the rear wall 28 thereof. This rear wall of the block is painted with a brilliant color such as red or orange, highly contrasting with the bolt, so that it may be easily seen. Thus, whenever the block is so raised out of the socket, it will indicate the presence of a cartridge in the chamber.

Figure 2:
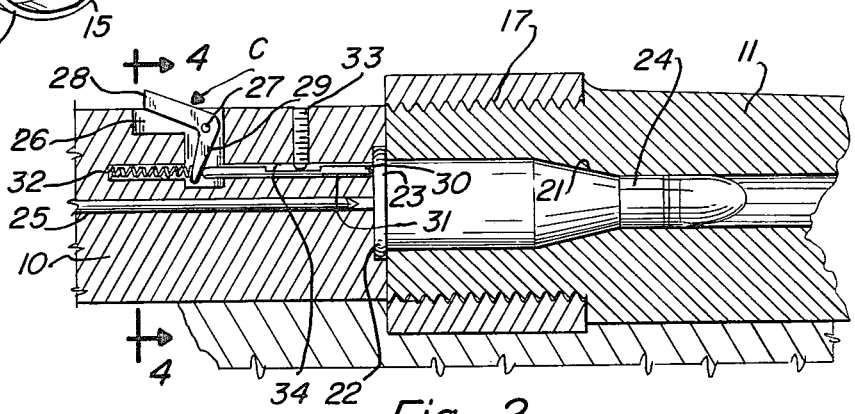
FIG. 2 is a fragmentary sectional detail as taken from the indicated line 2—2 at FIG. 1, but on an enlarged scale.
Figure 3:
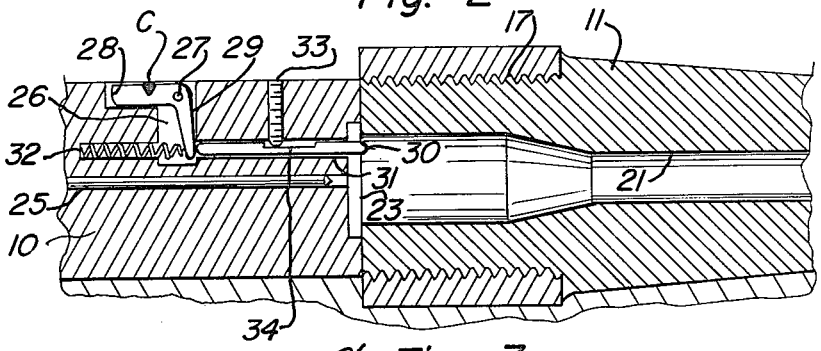
FIG. 3 is a fragmentary sectional detail similar to FIG. 2, but without a cartridge being in the chamber.

The socket 26 carrying this indicator is proportioned to receive a detent 29 extending from the front end of the indicator C and into the socket 26. A pin 30 is slidably fixed in a longitudinal passageway 31 in the bolt having one end at the socket 26 to abut against the detent 29 and the other end extending forwardly into the rim socket at the forward end of the bolt. The pin 30 thus will be extended into the rim socket when no cartridge is in the chamber. However, with a cartridge fitted into this rim socket, the pin seats against the cartridge and shifts rearwardly to push the detent 29 rearwardly to raise the indicator, as best shown at FIG. 2. The passageway 31, carrying the pin, is continued rearwardly beyond the socket to receive a compression spring 32 which resiliently urges the detent forwardly, the indicator C downwardly to its normal, downward, retracted position, and the pin 30 to its extended position in the rim socket 22 as illustrated at FIG. 3. To keep the pin 25 in position in its passageway 31, a lock screw 33 extends from the surface of the bolt at a point forwardly from the indicator and to the passageway 31 to abut against a flat notch or way 34 at the side of the pin as best illustrated at FIGS. 2 and 3.

The use and operation of this cartridge indicator C is manifest from the foregoing description. Whenever a cartridge 24 is in the chamber of the gun with the rim portion fitted into the socket 22 at the end of the bolt 10, the pin 30 is pushed into the passageway 31 and bears against the detent 29 to tip the indicator C. Thus, one can quickly tell whether or not the gun is loaded. If a cartridge 24 is not in the chamber 21, the slide pin 30 will extend into this chamber 21 to release pressure upon the detent and permit the indicator C to drop into its socket 26, such movement being urged by the spring 32.

Figure 7:
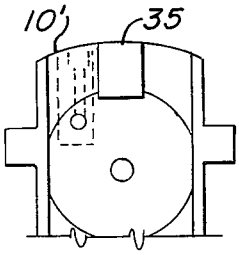
FIG. 7 is an end view as taken from the indicated arrow 7 at FIG. 5.
Figure 5:
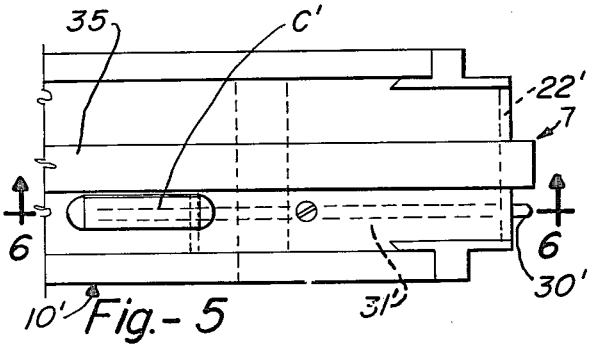
FIG. 5 is a plan view of a portion of a bolt for a gun of the type having a sliding bolt shafted by a lever, which incorporates the improved indicator in the bolt.
Figure 6:
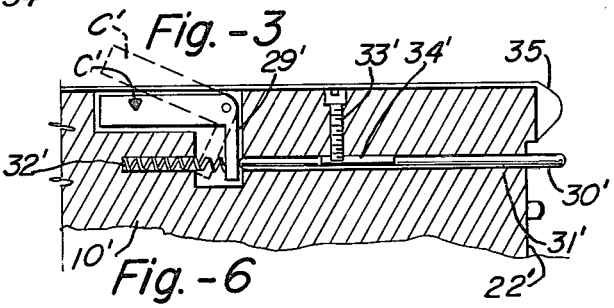
FIG. 6 is a longitudinal sectional view as taken from the indicated line 6—6 at FIG. 5, with the indicator being at a retracted position but with dotted lines showing the indicator in its raised position.

The arrangement shown at FIGS. 5, 6 and 7 illustrates the safety cartridge indicator mounted in the bolt 10' of another type of gun, a gun having a lever at the underside of the stock to shift the sliding bolt 10'. The bolt 10' will include a rim socket 22' at its face and a cartridge holding hook 35 to hold the rim 23 of a cartridge 24 much in the manner as heretofore described. The cartridge indicator C' is located at a suitable position as at the top of the bolt 10' for easy viewing, and where it will be out of the way of various portions of the receiver carrying this sliding bolt. The construction of this cartridge indicator C' is essentially the same as heretofore described. A pin 30', having one end projecting from the rim socket, is slidably carried in a passageway 31' with a lock screw 33' extending from the adjacent surface of the bolt 10' with its end in a notch or way 34' at the surface of the pin to limit its travel. The rear end of the pin 30' engages the detent 29' of the indicator C'. Also, a spring 32' abuts against this detent 29' to hold the indicator C' in a downward, retracted position whenever the cartridge chamber of the gun is empty. However, the presence of a cartridge in the chamber pushes the pin 30' against the detent to raise the indicator C' the same as heretofore described.

I have described preferred arrangements of the safety cartridge indicator for different types of rifles. It is apparent that the indicator can be used on other types of firearms. For example, the indicator can be used in a breech block which abuts directly against the back of a cartridge and has sufficient proportion as to accommodate a slide pin 30 and a cartridge indicator. Accordingly, it follows that others skilled in the art can build and devise alternate and equivalent constructions which are nevertheless within the spirit and scope of my invention. Hence, I desire that my protection be limited not by the constructions illustrated and described, but only by the proper scope of the appended claims.

What is claimed is:

1. A chambered cartridge indicator for fire arms having a fire arm receiver including a sliding and rotatable bolt engaging a cartridge chamber and a cartridge ejection slot in the firearm receiver comprising:

(a) reciprocable cartridge contact means mounted in a bore in the bolt including means to reciprocably secure said contact means in the bore, said contact means being positioned to contact a chambered cartridge and slide in an opposite direction from such cartridge and extend into the chamber in the absence of a cartridge, (b) pivoted striker means mounted in the bolt positioned to contact said contact means in the presence of a chambered cartridge and be pivoted thereby, (c) slot means in said bolt communicating with said striker means and positioned so as to be within the confines of the cartridge ejection slot with the bolt in closed position and at an angle to the sight line of the fire arm, (d) indicator means mounted in said slot means connected to said striker means and positioned to extend above the surface of the bolt and below the metal around the cartridge ejection slot when the bolt is closed and said contact means pivots said striker means, and (e) spring bias means normally holding said contact emans from pivoting said striker means and normally holding said indicator means below the surface of the bolt.

2. A chambered cartridge indicator according to claim 1, wherein said contact means in a slidable pin mounted in the bolt and the spring bias means is a helical compression spring arranged to bias against said striker means which bears against said pin.

* * * * *